US009144749B2

(12) United States Patent
Munch et al.

(10) Patent No.: US 9,144,749 B2
(45) Date of Patent: Sep. 29, 2015

(54) TOY BUILDING SYSTEM WITH FUNCTION BRICKS

(75) Inventors: Gaute Munch, Langa (DK); Erik Hansen, Randbol (DK)

(73) Assignee: LEGO A/S, Billund (DK)

( * ) Notice: Subject to any disclaimer, the term of this patent is extended or adjusted under 35 U.S.C. 154(b) by 706 days.

(21) Appl. No.: 13/060,505

(22) PCT Filed: Aug. 4, 2009

(86) PCT No.: PCT/EP2009/060121

§ 371 (c)(1),
(2), (4) Date: Feb. 24, 2011

(87) PCT Pub. No.: WO2010/023070

PCT Pub. Date: Mar. 4, 2010

(65) Prior Publication Data

US 2011/0151743 A1 Jun. 23, 2011

(30) Foreign Application Priority Data

Aug. 29, 2008 (DK) ..... 2008 01187

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)

(58) Field of Classification Search
USPC ..... 446/91, 477, 85, 175, 484
See application file for complete search history.

(56) References Cited

U.S. PATENT DOCUMENTS

| | | | | |
|---|---|---|---|---|
| 6,233,502 | B1 | 5/2001 | Yim | |
| 6,605,914 | B2 | 8/2003 | Yim et al. | |
| 6,939,192 | B1 | 9/2005 | Munch | |
| 7,371,177 | B2 * | 5/2008 | Ellis et al. | 463/42 |
| 2005/0057945 | A1 * | 3/2005 | Pipo et al. | 362/559 |

FOREIGN PATENT DOCUMENTS

| | | |
|---|---|---|
| EP | 1287869 | 3/2003 |
| WO | 01/97937 | 12/2001 |
| WO | 2006042549 | 4/2006 |
| WO | 2007137577 | 12/2007 |

* cited by examiner

*Primary Examiner* — Melba Bumgarner
*Assistant Examiner* — Amir Klayman
(74) *Attorney, Agent, or Firm* — Day Pitney LLP

(57) ABSTRACT

A toy building system comprising building elements with coupling means for releasably interconnecting building elements, the toy building system comprising function building elements with such coupling means and each having a function device adapted to perform a controllable function and an energy source for providing energy to the function device for performing the controllable function, each function building element comprising a light sensor for receiving visible light encoding a control signal; and a control circuit connected to the light sensor and to the function device and adapted to decode the received control signal and to control the controllable function responsive to the decoded control signal.

20 Claims, 2 Drawing Sheets

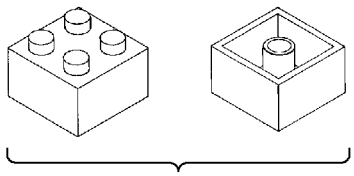
Fig. 1 - PRIOR ART
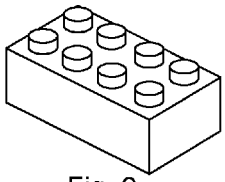
Fig. 2
PRIOR ART
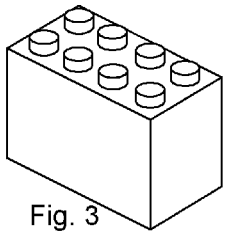
Fig. 3
PRIOR ART
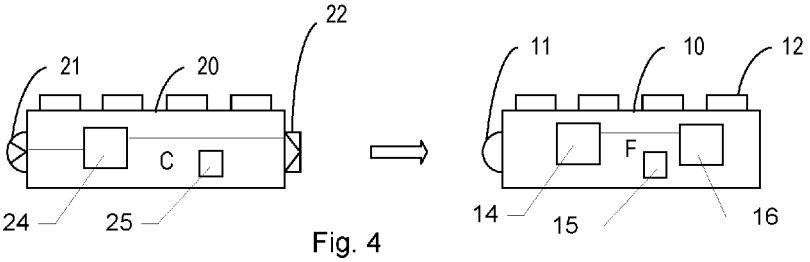
Fig. 4
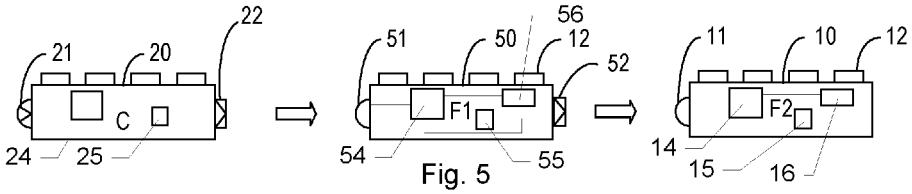
Fig. 5
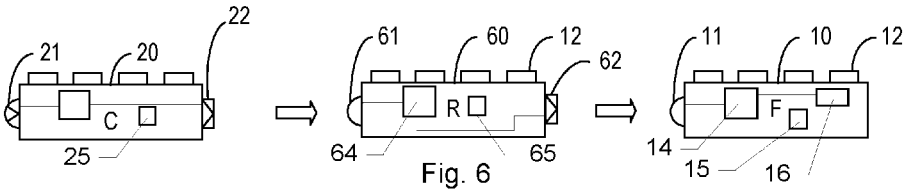
Fig. 6

TOY BUILDING SYSTEM WITH FUNCTION BRICKS

This application is the National Phase of PCT/EP2009/060121 filed on Aug. 4, 2009 which claims priority from Danish Patent Application No. PA200801187 filed on Aug. 29, 2008, the contents of which are incorporated herein by reference.

FIELD OF THE INVENTION

The invention relates to toy building systems comprising building elements with coupling means for releasably interconnecting building elements.

BACKGROUND

Such toy building systems have been known for decades. The simple building blocks have been supplemented with dedicated building elements with either a specific appearance or a mechanical or electrical function to enhance the play value. Such functions include e.g. motors, switches and lamps, but also programmable processors that accept input from sensors and can activate function elements in response to received sensor inputs.

Self-contained function building elements exist which have a function device adapted to perform a preconfigured function, an energy source for providing energy to the function device for performing the function, and a trigger responsive to an external trigger event to trigger the function device to perform the function. Typically, such known function building elements are designed for manual activation of a mechanical trigger and only provide a limited play value.

WO2007/137577 discloses a toy building system comprising function elements and control elements. The function and control elements are electrically interconnectable via a system of wires and plugs, such that the function elements receive both electrical power and control signals from the control elements. Even though this system avoids the need for an electrical power source in the function elements, it requires a certain level of abstract thinking and technical insight in order to correctly interconnect the building elements so as to construct functional toy models from such a system. In particular, an understanding of how a control structure constructed from such a building system works requires basic knowledge about electricity and that electrical signals may be used to control functions.

It thus remains a problem to provide a toy building system that allows small children, e.g. pre-school children, to construct and understand simple control systems.

It is thus generally desirable to provide a toy building system with new building elements that are suitable for use in such a system, and that will enhance the educational and play value of the system.

SUMMARY

Disclosed herein is a toy building system comprising building elements with coupling means for releasably interconnecting the building elements. Embodiments of the toy building system comprise function building elements with such coupling means and each having a function device adapted to perform a controllable function and an energy source for providing energy to the function device for performing the controllable function. Each function building element comprises a light sensor for receiving visible light encoding a control signal; and a control circuit connected to the light sensor and to the function device and adapted to decode the received control signal and to control the controllable function responsive to the decoded control signal.

Embodiments of the toy building system comprise one or more function building elements and one or more control building elements, each having coupling means to make them compatible with a toy building system with building elements having coupling means for releasably interconnecting the building elements.

Embodiments of a control building element with such coupling means comprise a sensor responsive to a predetermined input, and a light emitter for emitting visible light; and the control building element is adapted, in response to the predetermined input, to output, via the light emitter, visible light encoding a control signal corresponding to the predetermined input.

Consequently, a control interface between the control building elements and the function building elements is provided that is based on visible light, thus providing a visible indication to the user of the cause-and-effect chain that causes the control of the controllable functions. Hence, the control mechanism is intuitive and easy to work with also for smaller children.

For the purpose of the present description, the term visible light is intended to comprise light that is visible by the human eye, e.g. light having wavelengths predominantly chosen from a wavelength range between about 380 nm and about 780 nm. When the emitted light is colored light, e.g. using a part of the optical spectrum such as red light (e.g. predominantly in the wavelength range of about 625 nm and about 740 nm), green light (e.g. predominantly in the wavelength range of about 520 nm and about 570 nm) or blue light (e.g. predominantly in the wavelength range of about 440 nm and about 490 nm), it is easier for the user to detect and distinguish from ambient light.

The control signal may be encoded into the emitted light in any suitable way, e.g. by an amplitude modulation, a frequency modulation, a pulse width modulation, a pulse density modulation, a set of predetermined ON/OFF sequences, and/or the like. When the visible light is emitted as visible light pulses, and the control signal is encoded into the width, sequential pattern, and/or duration of the emitted light pulses, different control signals may be distinguishable by the user, thereby further increasing the educational value of the toy construction system. For the purpose of the present description, visible light encoding a control signal will also be referred to as visible light signal.

In some embodiments, all control building elements map the respective received inputs onto to a discrete set of control codes that is common for all control building elements, and each visible light signal is indicative of one of the set of control codes. Similarly, each function building element maps the control codes of the common set of control codes onto respective functions performable by the function device of the function building element.

Furthermore, embodiments of the control interface are operatable without moving parts and do not require the establishment of electrical contact between the control and function building elements, thereby providing a mechanically robust system that is suitable also for small children.

Furthermore, in embodiments of the toy construction system described herein, the function and control building elements do not need to be in immediate proximity to or even direct physical contact with each other in order to operate. Consequently a high degree of freedom is provided for the types of inputs that may be used as inputs to the control building elements, including inputs such as tilt or rotation that require relative movement or other manipulation of the control building element relative to the function building element.

It is a further advantage of embodiments of the toy construction system described herein, that function elements can easily be interchanged within a given toy structure without having to change the control interface.

When the toy building system further comprises at least one light guide for transmitting visible light, e.g. a flexible light guide such as a fibre-optic light guide, and when each light sensor and each light emitter comprises a connector for connecting the light guide to the corresponding sensor or emitter in optical communication, the sensors and light emitters do not need to be aligned with each other in a line of sight, i.e. the user does not need to aim with the light beam so as to hit the sensor.

When the light guide has a circumferential surface and two end faces for coupling in/out of light, and when the circumferential surface is adapted to emit a portion of the light coupled in at one of the end faces, it is directly visible to the user that the function is performed responsive to a received light signal, and that the control building element emits the light signal responsive to the input to the control building element.

In some embodiments, the coupling means are adapted to define a direction of connection and to allow interconnection of each building element with another building element in a discrete number of predetermined relative orientations relative to the building element; and all light sensors are arranged to receive light from a predetermined direction relative to the defined direction of connection. Similarly, all light emitters may be arranged to at least predominantly emit light into a predetermined direction relative to the defined direction of connection. Hence, such a toy construction system allows the construction of a toy structure where the control and function elements are interconnected with other building elements of the toy building system such that a proper alignment of the light emitters and the light sensors is easily ensured.

Some embodiments of a function building element may further comprise a light emitter for outputting a visible light signal, e.g. the received visible light signal or a visible light signal otherwise derived from the received visible light signal, e.g. a visible light signal encoding one of the set of common control codes derived from the control code encoded in the received visible light signal, thereby allowing the construction of a control structure including a chain of function building elements, where each function building element upon receipt of a visible light signal forwards a visible light signal to the next function building element in the chain.

Similarly, the toy construction system may comprise one or more relay building elements comprising a light sensor for receiving visible light encoding a control signal, and a light emitter for emitting a visible light signal, e.g. the received visible light signal or a visible light signal otherwise derived from the received visible light signal. Hence, upon receipt of a visible light signal, a relay building element may forward a visible light signal to the next function or relay building element in a control chain of such building elements, but without itself performing another function.

It will be appreciated that a function, control, or relay building element may include a plurality of light emitters for emitting visible light signals in respective directions, and/or a connector allowing the connection of a plurality of light guides to a light emitter, thus allowing such a control, function, or relay building element to operate as a divider/diverge node in a control chain.

The visible light signal output by a function or relay building element may be derived from the received visible light signal in a number of ways, e.g. by performing a predetermined mapping from a set of input signals and/or input control codes to a set of output signals and/or output control codes. In some embodiments, a function or relay building element may include a plurality, e.g. two, light sensors for receiving respective visible light signals. For example, a function building element may thus be adapted to control the function responsive to a predetermined function, e.g. a logical AND or OR function, of the received visible light signals. Similarly a function or relay building element may output a visible light signal responsive to such a predetermined function of the received visible light signals. It will be appreciated the a function or relay building element may include alternative means for receiving a plurality of channels of visible light signals in parallel, e.g. visible light signals in respective wavelength bands, e.g. red and blue light.

In some embodiments, at least some of the control, function, and/or relay building elements include a delay circuit for delaying the action performed responsive to the received input by a predetermined delay period. For example, a control building element may include a delay circuit for delaying the output of the visible light signal relative to the received input. Similarly, a function building element may include a delay circuit for delaying the performed function relative to the received visible light signal, and a function or relay building element may include a delay circuit for delaying the output of a visible light signal relative to the received visible light signal. Such delay of the responsive action may make the cause-and-effect chain of the control structure even more intuitive and easily perceptible by a user. For example, the predetermined delay may be chosen large enough to be perceptible by the user and short enough to not be mistaken as a malfunction of the system. For example the delay may be chosen less than about 1 sec. and larger than about 0.1 sec.

Consequently, function building elements with a uniform control interface based on visible light signals make the function building elements suitable for use in toy building systems, and increase the educational and play value.

Embodiments of the toy construction system allow a user to construct a large variety of functions and functional relationships in a uniform and well-structured manner and with a limited set of different construction elements. For example, a toy construction system may be provided as a toy construction set comprising a number of control building elements having different trigger sensors and a number of function building elements implementing respective functions. Optionally, such a toy construction set may comprise one or more of the following: a number of relay building elements, light guides corresponding to the number of control and function building elements, conventional building elements, an instruction manual, and/or the like.

It will be appreciated that embodiments of the toy construction system described herein provide a 1-way communication from a control building element downstream through a chain or network of function and/or relay building elements, thus providing a system for constructing control structures that is easy to understand even for smaller children, while at the same time allowing the construction of a variety of different and interesting control structures.

Similarly, when the function and relay building elements are provided without additional user-inputs, such as buttons, etc and/or when each control building element is provided with a single sensor for receiving an external trigger input, a simple system is provided that may be used by children for the construction of intuitive control structures.

BRIEF DESCRIPTION OF THE DRAWINGS

FIGS. 1-3 each show a prior art toy building brick,

FIGS. 4-6 show embodiments of a toy building system as disclosed herein,

DETAILED DESCRIPTION

Figure 7:
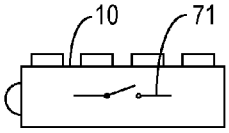
FIG. 7 schematically illustrates a toy building brick with a switch.

Various aspects and embodiments of toy building systems disclosed herein will now be described with reference to toy building elements in the form of bricks. However, the invention may be applied to other forms of building elements used in construction building sets.

In FIG. 1 is shown a toy building brick with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 2 and 3 show other such prior art building bricks. The building bricks shown in the remaining figures have this known type of coupling means in the form of cooperating studs and cavities. However, other types of coupling means may also be used. The coupling studs are arranged in a square planar grid, i.e. defining orthogonal directions along which sequences of coupling studs are arranged. This arrangement of coupling means allows the toy bricks to be interconnected in a discrete number of orientations relative two each other, in particular at right angles with respect to each other.

FIG. 4 shows a toy building brick 10 with a light sensor 11 on one of the side faces and coupling studs 12 on its top surface, and a toy building brick 20 with a sensor 21 and a light emitter 22 on respective ones of its side faces. In the shown embodiment, the toy building brick 10 illustrates a function building element where the light sensor 11 receives a visible light signal emitted from a control brick 20. Toy building brick 10 will thus also be referred to as function brick 10. The toy building brick 10 comprises a control circuit 14, e.g. a microcontroller, a microprocessor, or other suitable control circuitry, connected to the light sensor 11. The building brick 10 further comprises a function device 15 connected to the control circuit 14. The building brick 10 further comprises a power source 16, e.g. a battery, for providing power to the control circuit and the function device. The control circuit 14 is configured to decode the received light signal and to control the function device responsive to the decoded received signal. Upon receipt of the control signal, the control circuit 14 may further be adapted to delay the performance of the function by a predetermined delay period.

Generally, the light signal may be provided by any suitable light source. In particular, when the toy building brick 10 is used as a part of a system that includes a control and/or relay brick as described below, the light signal may be applied by a corresponding light emitter of a control or relay brick.

For example, in the embodiment shown in FIG. 4, the toy brick 20 illustrates an embodiment of a control building element for use in a toy building set comprising building elements with coupling means for releasably interconnecting building elements, e.g. the known bricks shown in FIGS. 1-3. The toy brick 20 will also be referred to as control brick 20. The control brick 20 has a sensor 21 that is responsive to a predetermined input. Examples of such predetermined inputs comprise mechanical forces, push, pull, rotation, tilt, human manipulation, touch, proximity of an object, electrical signals, radio frequency signals, optical signals, visible light signals, infrared signals, magnetic signals, temperature, humidity, radiation, etc.

The control brick 20 further comprises a light emitter 22, a control circuit 24 and a power source 25, e.g. a battery, for supplying the light emitter, the control circuit 24 and, optionally, the sensor 21 with electrical power. The control circuit 24, e.g. a microcontroller, a microprocessor, or other suitable control circuitry, is connected to the sensor 21 and to the light emitter 22. When the sensor 21 detects a predetermined input, the control circuit 24 controls the light emitter 22 to output a corresponding visible light signal. Upon receipt of the predetermined input via sensor 21, the control circuit 24 may be adapted to delay the emission of the visible light signal by a predetermined delay period. The visible light signal encodes a control signal that may be indicative of the presence of the received input via sensor 21 and/or the control signal may be indicative of a property of the received input, e.g. a direction of a rotation or tilt, or a degree of the detected quantity, e.g. the speed of a rotation or motion, a force, a temperature, a sound pressure, a light intensity, etc.

The light emitter 22 may be a light emitting diode (LED) or any other suitable light source. The light source may be adapted to emit light of a predetermined wavelength range so as to produce colored light, e.g. red, blue or green light. The light emitter may further include additional optical elements, e.g. a lens, an aperture, etc. for causing the light to be predominantly emitted in one direction, e.g. as a collimated light beam.

A toy construction set may comprise a plurality of control building elements. Preferably, each control building element is responsive to only a particular type of such physical events/conditions. Furthermore, all control building elements of a toy construction system preferably output a visible light signal of uniform nature, e.g. using the same wavelength band, and a uniform protocol for communicating control signals via the visible light signal. Preferably, all control building element light emitters are arranged in a uniform manner relative to the coupling means, e.g. to the coupling studs on the top surface and/or to the coupling cavity in the bottom of toy brick 20. This makes the control building elements interchangeable, and in a toy structure built from bricks as in FIGS. 1-3, several control bricks can be used interchangeably, and a particular control brick can be used in several constructions.

In the embodiment illustrated in FIG. 4, the light emitter 22 and the light sensor 11 are located on a side face of the respective toy brick, such that the light emitter 22 predominantly emits light in a direction parallel to the top and button surfaces, i.e. tangential to the plane defined by the regular planar grid defined by the coupling studs, and predominantly along a direction defined by the regular grid of the coupling studs.

Control bricks can be used alone with the toy building set or in combination with one or more function bricks described above.

FIG. 5 shows another example of a toy building system, comprising a control brick 20, a first function brick 50 and a second function brick 10. The control brick 20 and the function brick 10 are identical to the respective control brick and function brick shown in FIG. 4. The function brick 50 is similar to the function brick 10 and comprises a light sensor 51, a control circuit 54, a power supply 55, and a function device 56 as described in connection with the corresponding elements of the function device 10 shown in FIG. 4. The function brick 50 further comprises a light emitter 52 similar to the light emitter 22 of control brick 20. The light emitter 52 is located on a side face of the function brick 50, e.g. a side face opposite to the side face on which the light sensor 52 is located. The light emitter 52 is connected to the control circuit 54. When the function brick 50 receives a visible light signal, the control circuit 54 controls the function device 56 to perform the corresponding function as described in connection with function brick 10 shown in FIG. 4. Additionally, the control circuit 54 further controls the light emitter 52 to output a visible light signal, e.g. the received visible light signal or a visible light signal derived from the received visible light signal. Upon receipt of the visible light signal by sensor 51, the control circuit 54 may further be adapted to delay the emission of the visible light signal by a predetermined delay period.

Hence, function brick 50 illustrates an example of a function building element that outputs a visible light signal in addition to performing a function responsive to a received visible light signal, thereby allowing the construction of a chain of function building elements comprising 2, 3, or more function building elements.

In particular, FIG. 5 illustrates an intended use of the control and function bricks. A control brick 20, a function brick 50 and a function brick 10 are arranged in series as shown, and they may be interconnected with other building bricks of the toy building system. In the example of FIG. 5, the control brick 20 may respond to a predetermined input sensed by the sensor 21 by providing an output visible light signal on its light emitter 22. The function brick 50 receives on its light sensor 51 the visible light signal emitted by the control brick 20. The function brick 50 performs a function responsive to the received visible light signal, and outputs an output visible light signal on its light emitter 52. The function brick 10 receives on the light sensor 11 the visible light signal output by function brick 50 and performs a corresponding function.

FIG. 6 shows another example of a toy building system, comprising a control brick 20, a function brick 10 and a relay brick 60. The control brick 20 and the function brick 10 are identical to the respective control brick and function brick shown in FIG. 4. The relay brick 60 is similar to the function brick 50 shown in FIG. 5, but the relay brick does not include a function device. Hence, the relay brick comprises a light sensor 61, a control circuit 64, a power supply 65, and a light emitter 62. When the relay brick 60 receives a visible light signal, the control circuit 64 controls the light emitter 62 to output a visible light signal, e.g. the received visible light signal or a visible light signal derived from the received visible light signal. Upon receipt of the visible light signal by sensor 61, the control circuit 64 may be adapted to delay the emission of the visible light signal by a predetermined delay period.

Hence, relay brick 60 illustrates an example of a relay building element that relays a received visible light signal without performing a function responsive to a received visible light signal, thereby allowing the construction of a chain of function building elements and/or relay building elements comprising 2, 3, or more of such building elements.

The direction of communication from sensor 51 to emitter 52 in building block 50 and from sensor 61 to emitter 62 in building block 60 may be indicated on the respective building block, e.g. by means of a suitable symbol, suitable choice of colors, by the shape of the building block and/or in any other suitable way, thus allowing the user to easily distinguish between the sensor and the emitter and to properly align the building block. In an alternative embodiment, the building block may comprise two sensor-emitter pairs directed in respective directions, e.g. opposite directions. Thus, when the building block receives an input signal on the sensor of one of the sensor-emitter pairs, the building block may output a corresponding visible light signal on the emitter of the other sensor-emitter pair. Consequently, the risk of unintentionally using the building block in a wrong orientation is eliminated.

The interface between the function building elements, the relay building elements, and the control building elements may be defined in a uniform manner, e.g. based on a common set of control codes used by all control building elements and interpretable by all function and relay building elements of the toy building system. Each of the control bricks, the relay bricks and the function bricks are interchangeable with other bricks from the same group. Hence, when a toy construction set includes several function bricks and/or several control bricks and/or several relay bricks with uniformly arranged light sensors and emitters and using a uniform code transmitted via compatible visible light signals, a large variety of different functions triggered by different sensor inputs may be constructed simply by interchanging the various bricks.

In the following, examples of a communication protocol based on a predetermined set of control codes that can be communicated via a visible light signal will be described. In the following example, the set of control codes includes 12 distinct codes, referred to as VLL code 1 through VLL code 12. It will be appreciated that any other number of control codes may be used and/or that other types of communication protocols suitable to be implemented via a visible light signal may be employed instead.

For example, a control building element may include a tilt sensor configured to detect tilt operations in two dimensions, such that the input sensor may detect 5 distinct tilt positions: Neutral, i.e. no tilt, (N), forward tilt (F), backward tilt (B), right tilt (R) and left tilt (L). The control circuit of the control building element may thus translate some or all possible transitions between the tilt positions into respective ones of the control codes, e.g. according to the mapping of table 1.

TABLE 1 example of control code mapping for tilt sensor.

| Detected Action | Code |
|---|---|
| N → F | VLL code 1 |
| N → B | VLL code 2 |
| N → L | VLL code 3 |
| N → R | VLL code 4 |

It will be appreciated that a different mapping may be used.

Similarly, a control building element may include a rotation sensor, e.g. for detecting a rotation of the entire element or of a rotatable device, e.g. a wheel or axle included in the control building element. For example, the rotation sensor may be configured to distinguish two directions of rotation (labelled "forward" (F) and "backward" (B), respectively) and 3 rotational speeds (labelled "slow" (S), "medium" (M), and "fast" (F), respectively). Hence, the rotational sensor may detect 6 rotational states in addition to a neutral/stopped state, e.g. each state being labelled by a direction and a speed, e.g. SF for "slow forward", etc., and the neutral state being labelled S. The control circuit may translate each rotational state and/or transitions between rotational states into respective control codes, e.g. as shown in table 2.

TABLE 2

Example of control code mapping for rotational sensor.

| Detected action | Code |
|---|---|
| S → XF | VLL code 5 |
| S → XB | VLL code 6 |
| SF | VLL code 7 every 2 seconds |
| MF | VLL code 8 every second |
| FF | VLL code 9 every ½ second |
| SB | VLL code 10 every 2 seconds |
| MB | VLL code 11 every second |
| FB | VLL code 12 every ½ second |

In table 2, the labels XB and XF indicate any backward and forward state, respectively, irrespective of the speed. Hence, in this example, the respective codes for a transition between rotational states are transmitted once, while the codes for the respective states are transmitted at corresponding intervals; in this example, the intervals depend on the detected speed.

The above examples illustrate that a sensor of a control building element may be adapted to detect one of a set of states and/or transitions between such states, e.g. of the building element and/or of the external environment of the building element. The control building element may thus associate respective ones of a set of control codes with respective ones of the detectable states and/or with respective transitions between such states.

In the following, two examples of function building elements of the type illustrated by function brick 50 for performing respective actions and outputting an output visible light signal responsive to received visual light signals will be described:

In one embodiment, a function building element may include an RGB light source as a function device and thus be capable of emitting colored light, e.g. the colors labelled B, BG, G, GR, R, RY, Y, and YB. The control circuit may control the light source responsive to the control codes received encoded in the received visible light signal, e.g. according to the mapping shown in table 3 below. The control circuit may further control the light emitter of the function building element to output a visible light signal derived from the received visible light signal, e.g. according to the mapping shown in table 3.

TABLE 3

Example of functions and output codes of a function building element.

| Received Code | Action | Output code |
|---|---|---|
| 1 | Blue in 1 second | 2 |
| 2 | Green in 1 second | 3 |
| 3 | Red in 1 second | 4 |
| 4 | Yellow in 1 second | 1 |
| 5 | Blue in 1 second | 7 |
| 6 | Yellow in 1 second | 10 |
| 7 | 1 color step forward in 1 second | 7 |
| 8 | 1 color step forward in 1 second | 8 |
| 9 | 1 color step forward in 1 second | 9 |
| 10 | 1 color step backward in 1 second | 10 |
| 11 | 1 color step backward in 1 second | 11 |
| 12 | 1 color step backward in 1 second | 12 |

In another embodiment, a function building element may include a sound generator as a function device and be capable of emitting different preconfigured sounds at a number of speeds, e.g. at 3 speed levels, sp1, sp2, and sp3.

The control circuit may control the sound generator responsive to the control codes encoded in the received visible light signal, e.g. according to the mapping shown in table 4 below. The control circuit may further control the light emitter of the function building device to output a visible light signal derived from the received visible light signal, e.g. according to the mapping shown in table 4.

| Received Code | Action | Output code |
|---|---|---|
| 1 | Play sound 1 at sp1 | 2 |
| 2 | Play sound 2 at sp1 | 3 |
| 3 | Play sound 3 at sp1 | 4 |
| 4 | Play sound 4 at sp1 | 1 |
| 5 | Play current sound at sp1 | 7 |
| 6 | Play current sound at sp1 | 10 |
| 7 | Play next sound at sp1 | 7 |
| 8 | Play next sound at sp2 | 8 |
| 9 | Play next sound at sp3 | 9 |
| 10 | Play previous sound at sp1 | 10 |
| 11 | Play previous sound at sp2 | 11 |
| 12 | Play previous sound at sp3 | 12 |

In the above examples, the respective actions, i.e. the activation of the RGB light source and the activation of the sound generator, may be triggered by the receipt of the corresponding code. Upon receipt of a new code, the ongoing action may be interrupted. The output code may be transmitted immediately after receipt of the input code or with a predetermined delay.

In FIG. 7 is illustrated that the function device in the brick 10 can be a switch 71. The switch 71 can be a normally open or a normally closed switch, and its terminals can be connected to the coupling studs on the top surface or to the surfaces in the cavity that are intended for engaging coupling studs on other building bricks.

The function performed by the function device may e.g. be a mechanical function and/or and electrical function.

Figure 8:
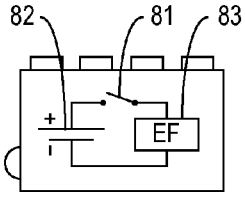
FIG. 8 schematically illustrates a function building brick with an electrical function and a battery for powering the electrical function, FIG. 9 schematically illustrates a function building brick with a mechanical function and a battery for powering the mechanical function, FIGS. 10 and 11 schematically illustrate examples of relay building elements.

In FIG. 8 is illustrated a function brick that has a battery 82 that stores electrical energy, and a switch 81 can be activated responsive to the received light signal, whereby an electrical function device 83 receives electric power from the battery 82, and the electrical function device 83 performs an electrical function.

Figure 9:
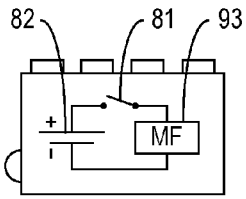

In FIG. 9 is illustrated a function brick that has a battery 82 that stores electrical energy, and a switch 81 can be activated responsive to the received light signal, whereby a mechanical function device 93 receives electric power from the battery 82, and the mechanical function device 93 performs a mechanical function.

Examples of a mechanical function that the function bricks described herein can perform include driving a rotating output shaft, winding-up a string or a chain which enables pulling an object closer to the function brick, fast or slow moving a hinged part of the function brick which enables e.g. opening or closing a door, ejecting an object, etc. Such mechanical motions can be driven by an electric motor powered by a battery 82 or a rechargeable electric capacitor, or another suitable power source.

Examples of an electrical function that the function bricks described herein can perform include operating a switch with accessible terminals, emitting constant or blinking light, activating several lamps in a predetermined sequence, emitting audible sound such as beep, alarm, bell, siren, voice message, music, synthetic sound, natural or imitated sound simulating and stimulating play activities, recording and playback of a sound, emitting inaudible sound such as ultrasound, emitting a radio frequency signal or an infrared signal to be received by another component, etc.

Hence, the function device may include any suitable mechanical and/or electrical device, arrangement or circuitry adapted to perform one or more of the above or alternative functions. Examples of function devices include a light source such as a lamp or LED, a sound generator, a motor, a hinged part, a rotatable shaft, a signal generator, or the like.

The light sensor may be arranged in a uniform manner relative to the coupling means, i.e. to the coupling studs on the top surface and/or to the coupling cavity in the bottom. This makes the function bricks interchangeable, and in a toy structure built from bricks as in FIGS. 1-3, several function bricks can be used interchangeably, and a particular function brick can be used in several constructions. A toy building system may comprise several of such function bricks responsive to respective light signals and providing different functions. Nevertheless, if all function bricks include light sensors responsive to the same type of visible light signals in a uniform manner, such function bricks may easily be interchanged within a toy construction built from the building bricks described herein. For example, a function brick including a lamp may simply be replaced by a function brick including a sound source or loudspeaker, without having to change any other part of the construction, since both function bricks are activated in the same way.

Figure 10:
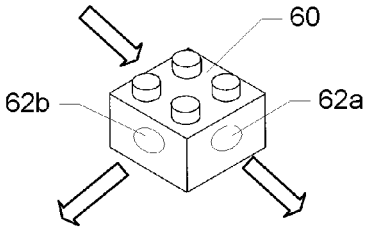

FIG. 10 illustrates a relay building element 60 having one light sensor (not explicitly shown) for receiving a visible light signal, and two light emitters 62*a* and 62*b*, each adapted to emit a visible light signal responsive to a received visible light signal. The relay building element 60 may control the light emitters to output the same visible light signal or different visible light signals. Hence, the relay building element of FIG. 10 may serve as a diverge that splits a single upstream control chain of function and/or relay building elements up into two downstream control chains. It will be appreciated that a toy building system may also include function building elements with more than one light emitters that may serve as a diverge.

Figure 11:
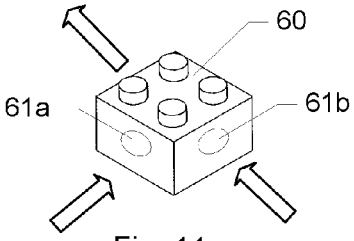

FIG. 11 illustrates a relay building element 60 having two light sensors 61*a* and 61*b* for receiving respective visible light signals, and a light emitter 62 (not explicitly shown) adapted to emit a visible light signal responsive to the received visible light signals. The relay building element 60 of FIG. 11 may control the light emitter to output a visible light signal determined from a combination of the received signals. For example, the relay element may emit a visible light signal only, if both sensors receive the same visible light signal simultaneously or at least within a predetermined time window, thus implementing an AND function. It will be appreciated that the relay building element alternatively may implement other functions of the two received signals. It will further be appreciated that a toy building system may also include function building elements with more than one light sensors that may implement a function of the receive signals.

Finally, it will be appreciated that a toy construction system may comprise further types of relay, function, and/or control elements, e.g. function or relay elements with more than two light sensors and/or more than two light emitters, function or relay elements with two or more light sensors and two or more light emitters, control elements with more than one input sensor and/or with more than two light emitters, control elements with a light sensor for receiving visible light signals in addition to the input sensor 21, etc.

Generally, when the light sensors of the function building elements, the light emitters of the control building elements, and the light inputs and outputs of the relay elements are positioned on a side face of the building elements that have coupling means on their top and bottom surfaces, the inputs and outputs do not interfere with the coupling means. Furthermore, this placement of the light interfaces allows the construction of entire sequences or even networks of function, control and relay elements within one horizontal layer/plane in a uniform fashion, that ensures alignment of the light emitted by a control, function, or relay element with the light sensor of another function or relay element without the need of an additional means of transmitting the trigger events, in particular without the need of any specific base plate for conveying the trigger actions/events from one building element to the next.

Figure 12:
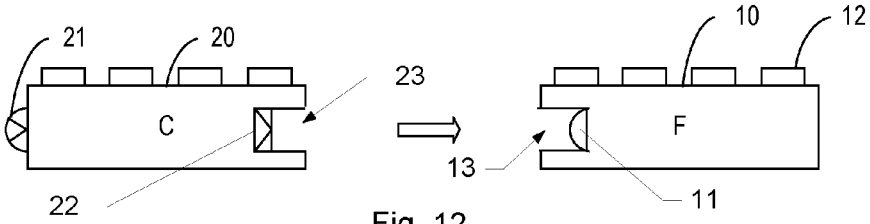
FIGS. 12 and 13 schematically illustrate another embodiment of a toy building system.
Figure 13:
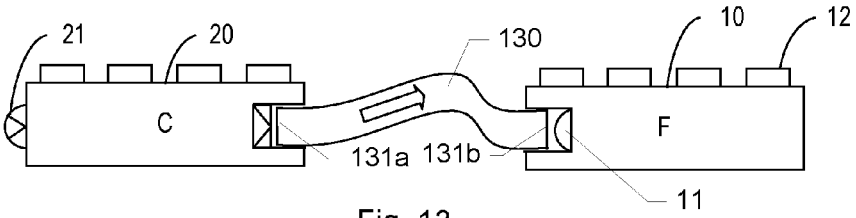

FIG. 12 shows another embodiment of a control brick 20 and a function brick 10. The control and function bricks are similar to the corresponding control and function bricks shown in FIG. 4, and even though not shown explicitly in FIG. 12, they may include the same components as the corresponding bricks of FIG. 4. The bricks of FIG. 12 differ from the corresponding bricks of FIG. 4 in that the light sensor 11 and the light emitter 22 are arranged in respective sockets 13 and 23, e.g. in the form of respective blind holes or other opening or socket. The sockets cause the light emitter to predominantly emit light in one direction, and cause the light sensor to predominantly receive light from one direction. Furthermore, the sockets may serve as connectors for a light guide as shown in FIG. 13. It will be appreciated that the control and function bricks of FIG. 12 may also include sensor-emitter pairs as described in connection with FIGS. 5 and 6.

FIG. 13 shows the control brick 20 and the function brick 10 of FIG. 12 connected by a flexible light guide 130, e.g. a fibre-optic light guide. The longitudinal end faces 131*a* and 131*b* of the light guide are shown inserted in the sockets 13 and 23, respectively, thereby providing an optical path between the light emitter 22 and the light sensor 11 and avoiding the need for a direct alignment of the emitter and sensor, and providing a private communication channel between the light emitter 22 and the light sensor 11.

When the light guide 130 is of the type that radiates a part of the received light received laterally through its circumferential surface, the visible light signals communicated via the light guide are visible to the user, thus allowing the user to observe the presence of a visible light signal being communicated and possibly even changes in the light intensity so as to make different control codes visible to the user, thus providing an intuitive communication interface. To this end the, light guide may be adapted in any suitable way that ensures that part of the light transmitted through the light guide escapes from the light guide. For example, this may be achieved by providing a fibre-optic light guide with imperfections/impurities to the sheath of the fibre or by providing the fibre with mechanical notches, patterns, or the like.

The sockets including light sensors and the sockets including light emitters may have different shapes (e.g. differently shaped cross-sections) or otherwise mechanically coded, and the light guides may have correspondingly shaped or otherwise mechanically coded end portions such that one end of the light guide only fits into the socket of a sensor, and the other end of the light guide only fits into the socket of an emitter, thereby automatically ensuring that the user connects building blocks in the correct orientation with respect to each other. It will further be appreciated that the building blocks may include other types of connectors for connecting a light guide.

Embodiments of the control elements of the building elements described herein can be implemented by means of hardware comprising several distinct elements, and/or at least in part by means of a suitably programmed microprocessor.

In the claims enumerating several means, several of these means can be embodied by one and the same element, component or item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

The invention claimed is:

1. A toy building system comprising:

building elements with connectors for releasably interconnecting building elements; and a first function building element with said connectors, the first function building element including:

a first function device configured to perform a first controllable function;

a first light sensor for receiving external visible light encoding a first control signal;

a first internal energy source for providing energy to the first function device for performing the controllable function responsive to the first control signal;

a first control circuit connected to the first light sensor and to the first function device that is configured to decode the received first control signal and to control the first controllable function responsive to the decoded first control signal; and a light emitter for emitting visible light encoding a second control signal;

at least a second function building element with said connectors, the at least a second function building element including:

a second function device configured to perform a second controllable function;

a second light sensor for receiving visible light encoding the second control signal from the light emitter of the first function building element;

a second internal energy source for providing energy to the second function device for performing the second controllable function responsive to the second control signal; and a second control circuit connected to the second light sensor and to the second function device that is configured to decode the received second control signal and to control the second controllable function responsive to the decoded second control signal;

wherein the first function building element is configured, in addition to performing the first controllable function, to forward, via the light emitter, visible light encoding the second control signal to the second function building element, wherein the second control signal is determined as at least one of (i) an output control signal as a function of the received first control signal, (ii) a delay of the received first control signal, (iii) a repetition of the received first control signal a predetermined number of times, and (iv) the received first control signal meeting a predetermined condition, and wherein the function building elements are connectable with building elements other than function building elements so as to form a toy structure such that each function building element is positioned within the toy structure spaced apart from and without direct physical or electrical contact to other of the function building elements, the function building elements configured to interact with one another by means of only the control signals.

2. A toy building system according to claim 1, wherein the controllable function is one of a motion, a generation of an audible sound signal, a generation of an inaudible sound signal, a generation of an electrical signal, a generation of a visible light signal, a generation of an invisible light signal, and a generation of a radio frequency signal.

3. A toy building system according to claim 1, further comprising a plurality of control building elements with connectors, the plurality of control building elements including a sensor responsive to a predetermined input, and a light emitter for emitting visible light; at least one of the control building elements being configured, in response to the predetermined input, to output, via the light emitter, visible light encoding a control signal corresponding to the predetermined input.

4. A toy building system according to claim 3, including a plurality of control building elements responsive to different predetermined inputs.

5. A toy building system according to claim 3, wherein each of the predetermined inputs is chosen from a mechanical force, a push action, a pull action, a rotation, a human manipulation, a touch, a proximity of an object, an electrical signal, a radio frequency signal, an optical signal, a visible light signal, an infrared signal, a magnetic signal, a temperature, a humidity, and a radiation.

6. A toy building system according to claim 1, further comprising a relay building element with connectors and comprising at least one light sensor for receiving visible light encoding a control signal and a light emitter for emitting visible light; the relay building element is being configured to determine an output control signal as a function of the received control signal; and to output, via the light emitter, visible light encoding the determined output control signal.

7. A toy building system according to claim 6, further comprising a plurality of relay building elements configured to determine output control signals as respective functions of the received control signal.

8. A toy building system according to claim 1, comprising a plurality of the function building elements whose function devices are configured to perform different functions.

9. A toy building system according to claim 1, further comprising the connectors with one or more protrusions and one or more cavities, each of the one or more cavities configured to receive at least one of the one or more protrusions in a frictional engagement.

10. A toy building system according to claim 1, wherein the connectors are positioned on at least one coupling face of the function building element and the light sensor and the light emitter are positioned on respective faces of the function building element different from said coupling face.

11. A toy building system according to claim 1, wherein the connectors are arranged to define a direction of connection and to allow interconnection of each building element with another building element in a discrete number of predetermined orientations relative to the building element, and each light sensor is arranged to receive light from a predetermined direction relative to the defined direction of connection.

12. A toy building system according to claim 1, wherein the connectors are arranged in one or more regular planar grids defining the direction of connection; and wherein each light sensor is arranged to receive light from a predetermined direction tangential to at least one of the planar grids.

13. A toy building system according to claim 1, wherein each of the function building elements has a top surface, a bottom surface, and at least one side surface; wherein said connectors are placed on at least one of the top and the bottom surface; and wherein each light sensor is arranged on said side surface.

14. A toy building system comprising:

building elements with connectors for releasably interconnecting building elements, a first function building element with said connectors, the first function building element including:

a first function device configured to perform a first controllable function;

a first light sensor for receiving external visible light encoding a first control signal;

a first internal energy source for providing energy to the first function device for performing the first controllable function responsive to the first control signal;

a first control circuit connected to the first light sensor and to the first function device that is configured to decode the received first control signal and to control the first controllable function responsive to the decoded first control signal; and a light emitter for emitting visible light encoding a second control signal;

at least a second function building element with said connectors, the at least a second function building element including:

a second function device configured to perform a second controllable function;

a second light sensor for receiving visible light encoding the second control signal from the light emitter of the first function building element;

a second internal energy source for providing energy to the second function device for performing the second controllable function responsive to the second control signal; and a second control circuit connected to the second light sensor and to the second function device that is configured to decode the received second control signal and to control the second controllable function responsive to the decoded second control signal;

wherein the first function building element further comprises a connector for connecting in optical communication a fiber optic light guide to at least one of (i) the light emitter and (ii) the first light sensor, the fiber optic light guide configured to transmit the visible light; and wherein the first function building element is configured both to determine an output control signal as a function of the received first control signal, and to forward, via the light emitter, visible light encoding the determined output control signal to the second function building element, the function building elements configured to interact with one another by means of only the output control signals.

15. A toy building system according to claim 14, wherein the light guide has a circumferential surface and two end faces for receiving and/or emitting light, and wherein the circumferential surface is configured to emit a portion of the light received at one of the end faces.

16. A toy building system according to claim 14, wherein the connectors are arranged in one or more regular planar grid defining the direction of connection; and wherein each light sensor is arranged to receive light from a predetermined direction tangential to at least one of the planar grids.

17. A toy building system according to claim 14, wherein each of the function building elements has a top surface, a bottom surface, and at least one side surface; wherein said connectors are placed on at least one of the top and the bottom surface; and wherein each light sensor is arranged on said side surface.

18. A toy building system according to claim 14, further comprising a control building element with such connectors, the control building element comprising a sensor responsive to a predetermined input, and a light emitter for emitting visible light; the control building element is configured, in response to the predetermined input, to output, via the light emitter, visible light encoding a control signal corresponding to the predetermined input; and wherein the light emitter is arranged to emit light in a predetermined direction relative to the defined direction of connection.

19. A toy building system according to claim 14, wherein the connectors are positioned on at least one coupling face of the function building element and the light sensor and the light emitter are positioned on respective faces of the function building element different from said coupling face.

20. A toy building system according to claim 14, wherein the connectors are arranged to define a direction of connection and to allow interconnection of each building element with another building element in a discrete number of predetermined orientations relative to the building element, and each light sensor is arranged to receive light from a predetermined direction relative to the defined direction of connection.

* * * * *